United States Patent [19]

Huber

[11] Patent Number: 4,681,530

[45] Date of Patent: Jul. 21, 1987

[54] GAS CONTROL DEVICE FOR CONTROLLING THE FUEL GAS AND OXIDIZING AGENT SUPPLY TO A BURNER IN AN ATOMIC ABSORPTION SPECTROMETER

[75] Inventor: Bernhard Huber, Uberlingen, Fed. Rep. of Germany

[73] Assignee: The Perkin-Elmer Corporation, Norwalk, Conn.

[21] Appl. No.: 863,770

[22] Filed: May 16, 1986

[30] Foreign Application Priority Data

Aug. 17, 1985 [DE] Fed. Rep. of Germany ..... 3529547

[51] Int. Cl.[4] ..... F23N 1/02

[52] U.S. Cl. ..... 431/89; 137/101.19; 137/100

[58] Field of Search ..... 431/89, 90; 137/100, 137/101.19

[56] References Cited

U.S. PATENT DOCUMENTS

| | | | |
|---|---|---|---|
| 3,905,394 | 9/1975 | Jerde | 431/89 |
| 4,220,413 | 9/1980 | Targowski et al. | 356/315 |
| 4,250,553 | 2/1981 | Sebens et al. | 364/510 |
| 4,277,254 | 7/1981 | Hanson | 137/101.19 |

FOREIGN PATENT DOCUMENTS 2113831 1/1982 United Kingdom .

*Primary Examiner*—Carroll B. Dority, Jr.
*Attorney, Agent, or Firm*—Ronald G. Cummings; Francis L. Masselle; Edwin T. Grimes

[57] ABSTRACT

The present invention is directed to a gas control device for controlling the fuel gas and the oxidizing agent supplied to a burner in an atomic absorption spectrometer. The device includes a pressure controller and a downstream flowmeter, connected to the aforesaid pressure controller in each of the device's supply conduits to an atomizer, oxidizing agent port and full gas port of the burner. Each flowmeter employed in the preferred embodiment of the invention is comprised of a turbine wheel which is exposed to the gas flowing through the flowmeter. By the rotation of the turbine wheel output, signals are generated depending on the angular rate thereof and thus as a function of the gas flow rate. These output signals are input into a control unit and a set of servomotors, each associated with one of said pressure controllers, are reproducibly adjusted under the control of said control unit, even under unstable pressure conditions, to selected gas flow rates.

11 Claims, 4 Drawing Figures

GAS CONTROL DEVICE FOR CONTROLLING THE FUEL GAS AND OXIDIZING AGENT SUPPLY TO A BURNER IN AN ATOMIC ABSORPTION SPECTROMETER

BACKGROUND OF THE INVENTION

1. Field of the Invention

The invention relates generally to gas control devices for controlling the fuel gas and oxidizing agent supply to a burner in an atomic absorption spectrometer and more particularly to gas control devices which are reproducibly adjustable.

2. Description of the Relevant Art

In an atomic absorption spectrometer, a line emitting light source emits a light beam, which comprises the resonant spectral lines of an element being looked for. This light beam passes through a flame from a burner and impinges upon a photoelectric detector. The liquid sample, which is to be analyzed, is sprayed into the flame by means of an atomizer. The sample is atomized by the flame and the elements present in the sample enter their atomic state. The attenuation of the light beam in the flame is indicative of the proportion of the element being looked for in the sample. The burner is operated with a fuel gas, for example acetylene, and air as the oxidizing agent. It is also known in the prior art to supply nitrous oxide gas ($N_2O$) as the oxidizing agent, instead of air, to the burner in order to obtain a hotter flame. Nitrous oxide has a higher proportion of oxygen than air and when it is used the supply of fuel gas is increased in order to provide the correct stoichiometric ratio of fuel gas and oxidizing agent.

In one type of prior art gas control device, needle valves are provided for the adjustment of the gas flows. The gas flows are indicated by means of a flow meter and adjusted by manual adjustment of the needle valves. In order to ensure maintenance of the gas flows once adjusted, a pressure regulator (or pressure reducer) is located upstream of each needle valve. These pressure regulators maintain constant pressure upstream of each needle valve. Thus, the gas flows are adjusted and regulated by means of adjustable restrictors at a constant inlet pressure.

Usually, the flame is first ignited with air as the oxidizing agent. The changing-over to nitrous oxide gas, if required, does not take place until after the flame is ignited. The increase in the fuel gas flow required, when operating with nitrous oxide, is obtained by opening a bypass to the needle valve.

In the above described type of prior art gas control device, the gas flows were adjusted by hand at the needle valves. Therefore, the gas control device had to be arranged so that the needle valves were easily accessible. This required, in many cases, relatively long conduit connections with the device.

A second type of adjustable prior art gas control device is described in copending application Ser. No. 704,830, U.S. Pat. No. 4,640,677, assigned to the same assignee to which this invention is assigned, in which the adjustment to gas and oxidizing agent flow is accomplished by control signals from an operating unit or a control unit. This copending application is hereby incorporated by reference.

According to the invention taught in the referenced copending application, the new and improved gas control device includes, in combination, a first restrictor and a first pressure regulator for the fuel gas line, and a second restrictor and a second pressure regulator for the oxidizing agent line, the regulators being connected upstream of the restrictors, respectively, and servomotors for reproducibly adjusting the pressure settings of the pressure regulators, respectively.

As a result, for adjusting the flow, the flow cross sectional area is not varied with constant pressure; rather the pressure is varied with a fixed restrictor. Consequently, the expensive needle valves required by the first mentioned type of prior art device are eliminated.

The use of a servomotor for the adjustment of the pressure regulator to a desired value permitted adjustment by control signals. Consequently, it was not necessary to make the restrictors easily accessible, as was the case with devices employing needle valves, which had to be adjustable by hand.

Also, since the pressure could be easily and reproducibly adjusted as desired, and each such pressure could be associated unambiguously with a certain flow, no additional flowmeters were required. The flow of the fuel gas could be increased in a well-defined manner by the servomotor, and the desired value of the pressure regulator would be readily obtainable, when changing over to a second oxidizing agent having a higher proportion of oxygen, such as, for example, nitrous oxide. A by-pass around the restrictor and control means as required by the first type of prior art devices could be omitted.

Although the device taught in the referenced copending application is indeed controllable and permits reproducible adjustments, particular situations make reproducible adjustment difficult. For example, if the atomizer nozzle has been displaced or the input prepressure has changed, the required variation to the servomotor control signals to account for these situations is not a factor known apriori.

The principal object of the present invention, therefore, is to provide a gas control device of the second type mentioned above, which permit reproducible adjustment of the gas flow rates even under unstable conditions such as input prepressure variation.

According to the invention this object is achieved by locating a flowmeter downstream of each pressure regulator and connecting each flowmeter to the control unit. In this way a feedback of the actual gas flow rate to the control unit is made and the adjustment of the pressure controls can be effected such that the desired gas flow rate is reproducibly adjusted.

Various flowmeters for measuring gas flow rates are know, e.g. suspension body type flow rate measuring devices and transducers. Such flowmeters however can be used only with difficulties in gas control devices working automatically. For example, the output of known, in suspension body type flow rate measuring devices, are not amenable to being evaluated directly by a control unit. Furthermore, the indicator of such suspension body type flow rate measuring devices is not sufficiently precise in the presence of elevated pressures as, for example, under the pressures typically required to operate an atomizer nozzle. Transducers are problematic because they supply analog output signals and therefore require additional A/D-converters.

To solve the aforesaid problems with known flowmeters, the preferred embodiment of the invention includes a flowmeter formed by a turbine wheel rotatably mounted in a housing. Signal generating means cooperating with the turbine wheel are provided to generate an output signal depending on the angular rate of the turbine wheel. The housing comprises a gas inlet and a gas outlet directed to the turbine wheel. The output signals of these flowmeters can immediately be supplied to the control unit and be evaluated. Thus the desired reproducibility of the adjustment of the gas flow rate for all operating conditions is achieved independent of, for example, new adjustments of the atomizer and changes of the prepressure applying to the pressure control.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis of the designing of other apparatus for carrying out the various purposes of the invention. It is important, therefore, that this disclosure be regarded as including such equivalent apparatus as do not depart from the spirit and scope of the invention.

One embodiment of the invention has been chosen for purposes of illustration and description, and is shown in the accompanying Drawing forming a part of the specification.

BRIEF DESCRIPTION OF THE DRAWING

FIG. *2a* and *2b* show a longitudinal section and cross section respectively of a flowmeter in the gas control device of FIG. 1.

DETAILED DESCRIPTION

Figure 1:
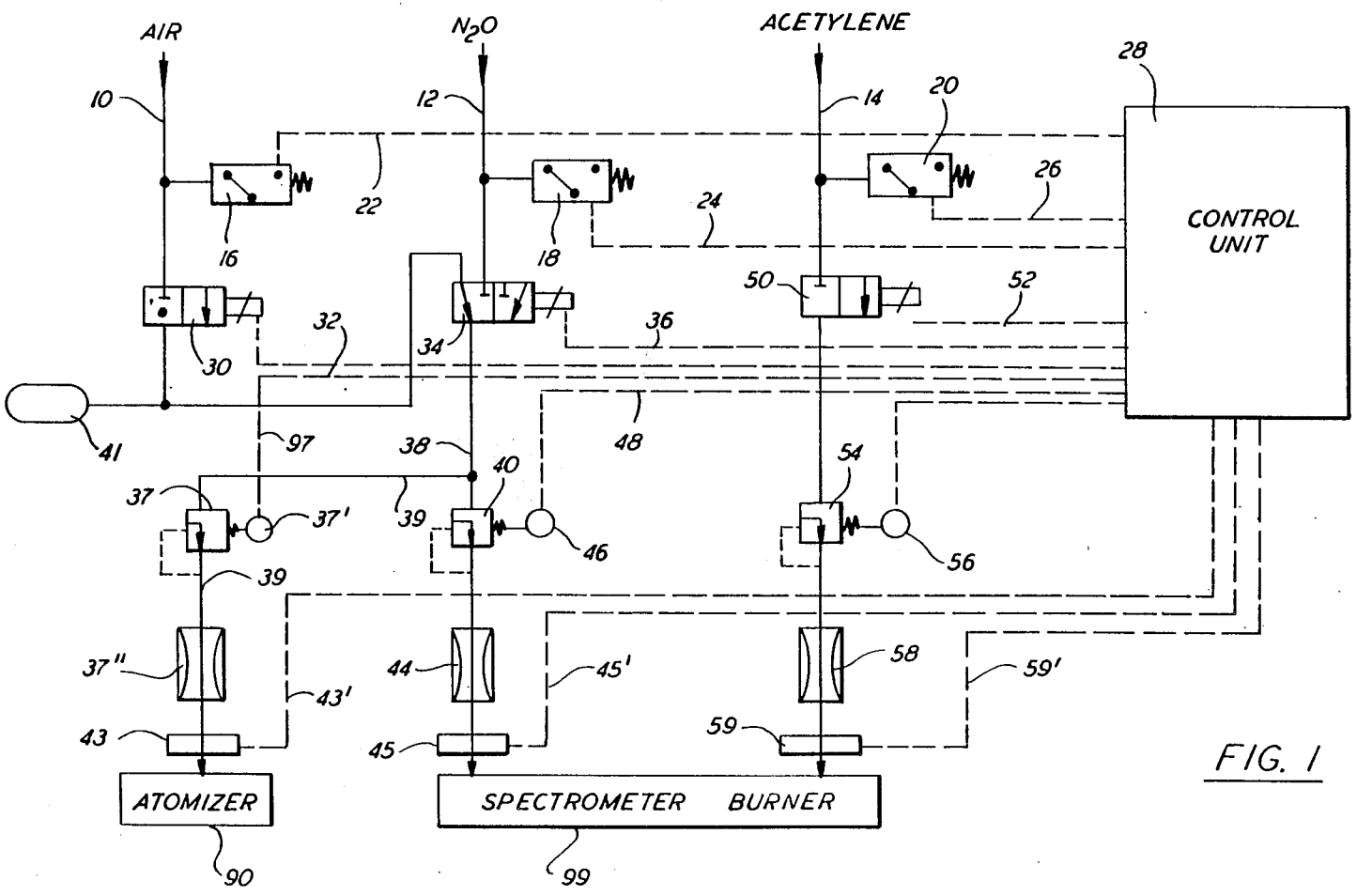
FIG. 1 shows a block diagram of the gas control device according to the invention.
Figure 2A:
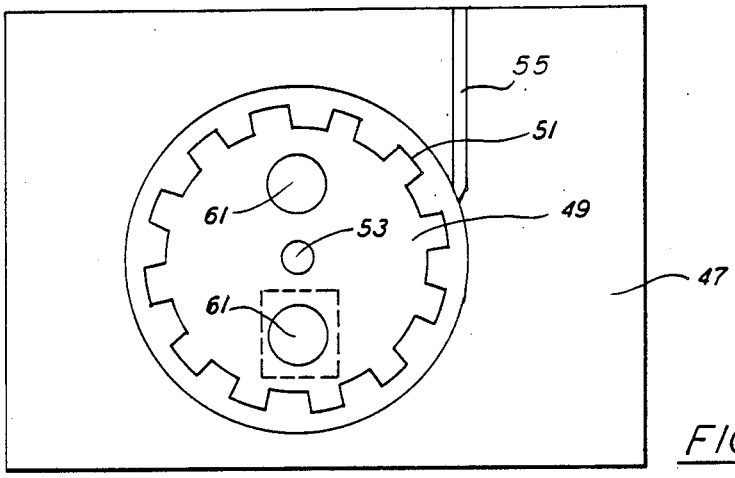
Figure 2B:
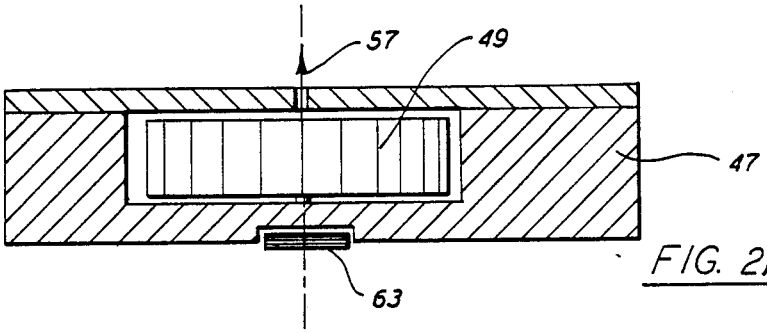

Referring to FIG. 1, the gas control device comprises a first port 10, to which air as a first oxidizing agent in the form of compressed air can be connected, and a second port 12, which can be connected to a source of $N_2O$ as a second oxidizing agent. A third port 14 can be connected to a source of fuel gas, preferably acetylene. Pressure sensors 16, 18 and 20 are connected to the ports 10, 12 and 14, respectively. The pressure sensors 16, 18, 20 signal whether or not a gas pressure is being applied to the port in question. These signals are applied to a control unit 28 through signal lines 22, 24 and 26, respectively. Control unit 28 is preferably a microprocessor-controlled electronic system as described in the incorporated copending application.

A shut-off valve 30, preferably a solenoid valve, is arranged downstream of the first port 10. This valve is controlled by the control unit 28 through a control line 32, which is closed in its deenergized state.

A 3/2-directional control valve 34, preferably a solenoid valve, is controlled by the control unit 28 through a control line 36. In its first position the 3/2-directional control valve 34 connects the first port 10 and the shut-off valve 30, arranged downstream thereof, to a conduit 38, while the second port 12 is closed. In its second position the 3/2-directional control valve 34 connects the second port 12 to the conduit 38, while communication with the shut-off valve 30 and the first port 10 is shut-off. In its deenergized state the 3/2-directional control valve 34 is in its first position, as illustrated in FIG. 1.

Still referring to FIG. 1, a branch conduit 39 extends from the conduit 38, through a pressure controller 37, to an atomizer 90. A storage container 41 is connected between the shut-off valve 30 and the 3/2-directional control valve 34.

The conduit 38 is connected to a pressure regulator 40. The outlet of the pressure regulator 40 is connected to an oxidizing agent port of burner 99 of an atomic absorption spectrometer through a fixed restrictor 44. The pressure regulator 40 is a conventional pressure reducing valve, the desired setting value of which is variably controlled through an actuating spindle as described in detail in the incorporated copending application. The actuating spindle is movable by an appropriate pick-off means, e.g. servomotor 46. Servomotor 46 sends position signals to the control unit 28 and is, accordingly, controlled by the control unit. It is connected thereto as indicated by line 48 of FIG. 1. A similar arrangement is shown for moving the actuating spindle of pressure controller 37 via servomotor 37' and control line 97.

A shut-off valve 50, preferably a solenoid valve, is arranged downstream of the third port 14. The shut-off valve is controlled by the control unit 28 through a control line 52. The third port 14 is connected to a pressure regulator 54 through the shut-off valve 50. The pressure regulator 54 is also a conventional pressure reducing valve similar to the pressure regulator 40. A servomotor 56 moves an actuating spindle of the pressure regulator 54 for adjusting it to a desired value. The servomotor 56, or appropriate pick-off means, supplies position signals to the control unit 28. The servomotor 56 is controlled, correspondingly, by the control unit 28. The output of the pressure regulator 54 communicates with a fuel gas port of the burner 99 through a fixed restrictor 58. In one form of the invention the servomotors 37'', 46 and 56 are in the form of stepping motors.

FIG. 1 goes on to show flowmeter 43 arranged downstream of the pressure controller 37 in the branch conduit 39 through a restrictor 37''. The signal line 43' of the flowmeter 43 is shown connected to control unit 28. Flowmeters 45 and 59 are shown downstream of the pressure controllers 40 and 54, following restrictors 44 and 58 respectively. The signal lines 45' and 59' associated with flowmeter 45 and 59 respectively, are shown connected to control unit 28. Pressure controllers 37, 40 and 54 are preferably of the type, and are preferably operated in the manner, described in detail in the copending application incorporated herein by reference.

According to the invention, each flowmeter (43, 45 and 59) is preferably constructed in the manner shown in FIG. *2a* and *2b*. In a generally sealed housing 47 a turbine wheel 49 having vanes 51 is rotatably mounted in bearing 53. A gas inlet 55 is nozzle-shaped and tangentially aligned with the vanes 51 of the turbine wheel 49. A gas outlet 57 of the housing 47 is connected to the conduit coupled to the atomizer, to the oxidizing agent port or to the fuel gas port of the burner.

Each flowmeter (43, 45 and 49) comprises means cooperating with the turbine wheel 49 for generating signals for indicating the gas flow rate. In the described embodiment the turbine wheel 49 is provided with two magnets 61 arranged on diametrically opposite locations which e.g. can be embedded in the synthetic material of which the turbine wheel 49 consists. In the housing 47, in the range of action of the magnets 61, a Hall sensor 63 is arranged which is connected with signal line 43', 45' or 59' respectively.

When the turbine wheel 49 rotates, an output signal is generated at the Hall sensor 63 when one of the magnets 61 arranged on the turbine wheel 49 passes the Hall sensor 63. The frequency of this output signal depends on the angular rate of the turbine wheel 49 and thus on the flow rate of the gas hitting the turbine wheel 49 through the inlet 55. The occurrence of these output signals can be used in different ways for the determination of the flow rate of the gas. So, for example, the time between the occurrence of two sequential output signals can be determined. In such an arrangement the flow rate S, which, for example, can be given in l/min, is determined by the number N of the counted impulses of a counter between two consecutive output signals of the Hall sensor 63 as the following relation shows:

$$S=K\cdot N^{-m}$$

where K and m are arrangement dependent parameters which are empirically determined. The values of these parameters are dependent on the structure of the gas inlet 55 in the housing 47, on the construction of the housing 47 and on the shape of the turbine wheel 49. In addition, these parameters, mainly K, are dependent on the kind and composition of the gas flowing through the housing 47 and driving the turbine wheel 49. However, the parameters can be determined precisely for each arrangement and each gas, such that once determined the gas flow rate can be measured with high accuracy and can be adjusted reproducibly by the control unit 28 and the pressure controllers 37, 40 and 54.

Instead of the magnets 61 and the Hall sensor 63 representing particularly simple and easily realized signal generating means, other signal generating means, which preferably operate contactless, can be used, which permit determination of the angular rate of the turbine wheel 49.

The output signals of the Hall sensor 63 input into the control unit 28 are processed in the control unit 28. Control unit 28 compares the input signal values with stored or preset desired values for certain conditions e.g., $N_2O$ as the oxidizing agent. In case of deviations from desired values the respective controllers 37, 40 and 54 are adjusted by the associated servomotors 37', 46 and 56. The program steps for controlling the servomotors based on the results of the aforesaid comparisons (i.e. varying the servomotor control signals) are considered well within the skill of the art and the manner in which these steps are implemented does not constitute a part of the present invention.

Figure 3:
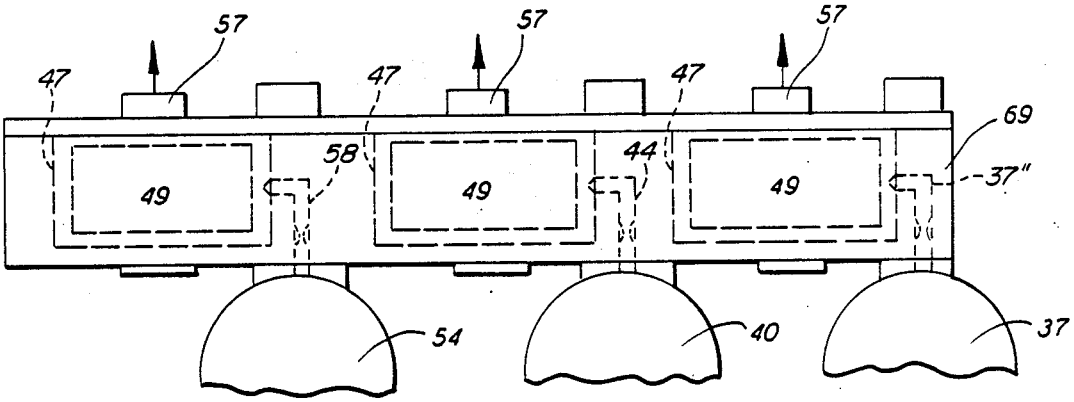
FIG. 3 shows schematical illustration of the arrangement of the flowmeters of FIG. 2 in the gas control device of FIG. 1.

An advantageous arrangement of the flowmeters is schematically illustrated in FIG. 3. The housings of the three flowmeters 43, 45 and 59 are arranged together as block 69, which is directly connected to the pressure controllers, 37, 40 and 54. In this case the gas inlets 55 of the individual housings 47 in the block 69 are formed by the flow restrictors of the type of the flow restrictors 37'', 44 and 58. The gas outlets 57 are provided in the block 69, the conduits leading to the atomizer, the oxidizing agent port and the fuel gas port of the burner communicating directly with these gas outlets.

The housing 47 as a whole or its portions in the area of the turbine wheel 49 ideally consist of non-magnetic metal. Thereby the turbine wheel 49 is damped by eddy currents which are caused by rotation of the turbine wheel. This offers the advantage that the service life of the devices is increased and the frequency of the signals generated by the Hall sensor 63 is kept low whereby the measuring accuracy is improved.

The foregoing description of a preferred embodiment of the novel device for achieving the objects of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the instant invention and its practical application to thereby enable others skilled in the art to best utilize the instant invention in various embodiments and with various modifications as are suited to the particular use contemplated. It is intended that the scope of the instant invention be defined by the claims appended hereto.

What is claimed is:

1. A gas control device for controlling the fuel gas and oxidizing agent supply to a burner (99) in an atomic absorption spectrometer, comprising:

(a) a fuel gas line (14) for supplying fuel gas to said burner (99);

(b) an oxidizing agent supply line (10, 12) for supplying an oxidizing agent to said burner (99);

(c) a first restrictor (58) and a first pressure regulator (54) connected upstream of said first restrictor for said fuel gas line;

(d) a second restrictor (44) and a second pressure regulator (40) connected upstream of said second restrictor for said oxidizing agent line;

(e) first (56) and second (46) servomotors for reproducibly adjusting the pressure settings of said pressure regulators, respectively;

(f) a control unit (28), by means of which the servomotors are controllable in a reproducible manner; and (g) first (59) and second (45) flowmeters connected to control unit 28, wherein said first flowmeter (59) is connected downstream of said first restrictor (58) and said second flowmeter (45) is connected downstream of said second restrictor (44), for providing said control unit with a measure of the rate of flow of said fuel gas and said oxidizing agent.

2. A gas control device as set forth in claim 1 further comprising:

(a) a branch conduit (39), located upstream of said second pressure regulator (40), for guiding said oxidizing agent through a third restrictor (37''), connected downstream from a third pressure regulator (37), to an atomizer (90);

(b) a third servomotor (37'), for reproducibly adjusting the pressure settings of said third pressure regulator (37) in response to signals from said control unit (28); and (c) a third flowmeter (43), connected to control unit (28) and connected downstream of said third restrictor (37''), for providing said control unit (28) with a measure of the rate of flow of said oxidizing agent to said atomizer (90).

3. A gas control device as set forth in claim 2 wherein each of said flowmeters further comprises:

(a) a turbine wheel (49) rotatably mounted in a housing (47); and (b) signal generating means cooperating with said turbine wheel (49) for generating an output signal as a function of the angular rate of said turbine wheel (49).

4. A gas control device as set forth in claim 3 wherein said housing (47) is further comprised of a gas inlet (55) directed to the turbine wheel (49) and a gas outlet (57).

5. A gas control device as set forth in claim 3 wherein said signal generating means is formed by at least one magnet (61) arranged on the turbine wheel (49) and a Hall-sensor (63), provided at the housing (47), connected to said control unit (28).

6. A gas control device as set forth in claim 5 wherein said signal generating means further comprises two diametrically opposite magnets (61) arranged on the turbine wheel (49).

7. A gas control device as set forth in claim 3 wherein each of said restrictors (37", 44, 58) is arranged between each of said pressure regulators and each of said flowmeters (43, 45, 59), and further wherein each of said restrictors forms a nozzle-shaped gas inlet (55) of the housing (47) for the flowmeter to which it is connected.

8. A gas control device as set forth in claim 7 wherein the housings (47) of said flowmeters (43, 45, 59) are arranged in a common block (69), and further wherein each of said restrictors (37", 44, 58) is connected at the inlet side of said common block to form the gas inlets (55) of each housing (47).

9. A gas control device as set forth in claim 8 wherein each housing (47), at least in the area of said turbine wheel (49), consists of non-magnetic metal.

10. A gas control device as set forth in claim 8 wherein said servomotors (37', 46, 56) are formed by stepping motors.

11. A gas control device as set forth in claim 8 wherein the control unit (28) is a microprocessor-controlled electronic system.

* * * * *